US006454476B1

(12) United States Patent
Negatu et al.

(10) Patent No.: US 6,454,476 B1
(45) Date of Patent: Sep. 24, 2002

(54) APPARATUS AND METHOD FOR PICKING AND FEEDING PRINT MEDIA SHEETS

(75) Inventors: Matias Negatu; Szymon Morawski, both of Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/292,038

(22) Filed: Apr. 14, 1999

(51) Int. Cl.[7] ..... B41J 13/02; B41J 11/58; B41J 15/24; G03G 15/00

(52) U.S. Cl. ..... 400/636; 400/625; 400/617; 399/384

(58) Field of Search ..... 271/117; 355/316; 399/384; 400/629, 625, 600.3, 602, 617, 624, 636.2

(56) References Cited

U.S. PATENT DOCUMENTS

| | | | | | |
|---|---|---|---|---|---|
| 3,861,670 | A | * | 1/1975 | Kraft | 271/122 |
| 4,248,415 | A | | 2/1981 | Steinhilber | 271/9 |
| 4,253,652 | A | | 3/1981 | Steinhilber | 271/8 |
| 4,285,607 | A | | 8/1981 | Steinhilber | 400/625 |
| 4,416,559 | A | | 11/1983 | Steinhilber | 400/629 |
| 4,632,379 | A | | 12/1986 | Steinhilber | 271/127 |
| 4,635,923 | A | | 1/1987 | Steinhilber | 271/162 |
| 4,648,590 | A | | 3/1987 | Paulat | 271/272 |
| 4,863,153 | A | | 9/1989 | Steinhilber | 271/9 |
| 4,883,378 | A | | 11/1989 | Steinhilber | 400/624 |
| 4,986,530 | A | | 1/1991 | Steinhilber | 271/297 |
| 5,052,836 | A | * | 10/1991 | Genno | 400/629 |
| 5,078,377 | A | * | 1/1992 | Dubois | 271/3 |
| 5,172,908 | A | | 12/1992 | Steinhilber | 271/288 |
| 5,192,066 | A | | 3/1993 | Steinhilber | 271/9 |
| 5,193,794 | A | | 3/1993 | Steinhilber | 271/9 |
| 5,377,969 | A | | 1/1995 | Steinhilber | 271/21 |
| 5,461,468 | A | * | 10/1995 | Dempsey et al. | 355/316 |
| 5,624,196 | A | * | 4/1997 | Jackson et al. | 400/625 |
| 5,722,654 | A | * | 3/1998 | Sootome et al. | 271/119 |
| 5,806,842 | A | | 9/1998 | Steinhilber | 270/58.08 |
| 5,899,613 | A | * | 5/1999 | Koike et al. | 399/384 |

FOREIGN PATENT DOCUMENTS

| | | |
|---|---|---|
| WO | WO 84/01130 | 3/1984 |

* cited by examiner

*Primary Examiner*—Andrew H. Hirshfeld
*Assistant Examiner*—Marvin P Crenshaw

(57) ABSTRACT

An apparatus and method for picking and feeding a single sheet from a stack. A pick roller and a retard roller are held together in a pick assembly, and positioned so that the pick roller is in contact with the top surface of the top sheet and adjacent a leading edge of the top sheet. The pick roller is driven to pick a sheet from the stack, pulling the sheet into the nip between the pick roller and the retard roller. The retard roller applies a retard force to the retard roller tending to resist the rotation of the retard roller as print media is driven into the nip during a pick operation. The retard force is less than a feed force applied to the top sheet by the pick roller as the top sheet is passed into the nip, the retard force being greater than a sheet-to-sheet frictional drag force between the top sheet and an adjacent sheet, thereby separating an adjacent sheet from the top sheet to prevent multiple sheet picks. The retard force is applied by a torque limiter incorporated in the retard roller structure. A suspension apparatus is coupled to the pick roller and retard roller assembly for permitting the assembly to move through a range of movement as the height of the media stack changes due to repeated pick operations, such that the pick roller is in contact with the top sheet for media stacks of varying heights.

18 Claims, 5 Drawing Sheets

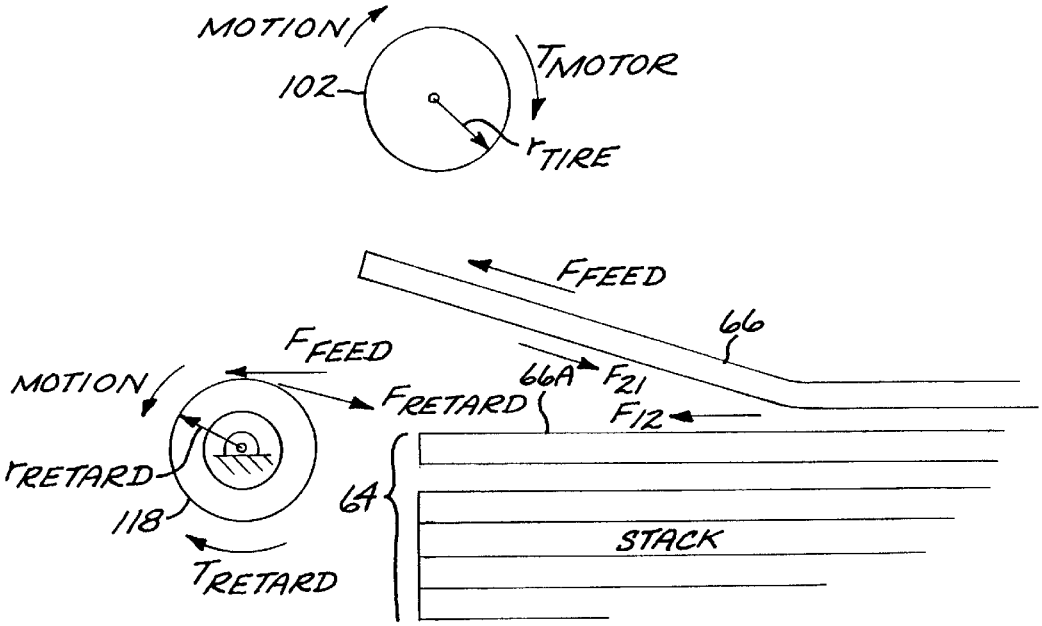
FIG.5
FIG.6
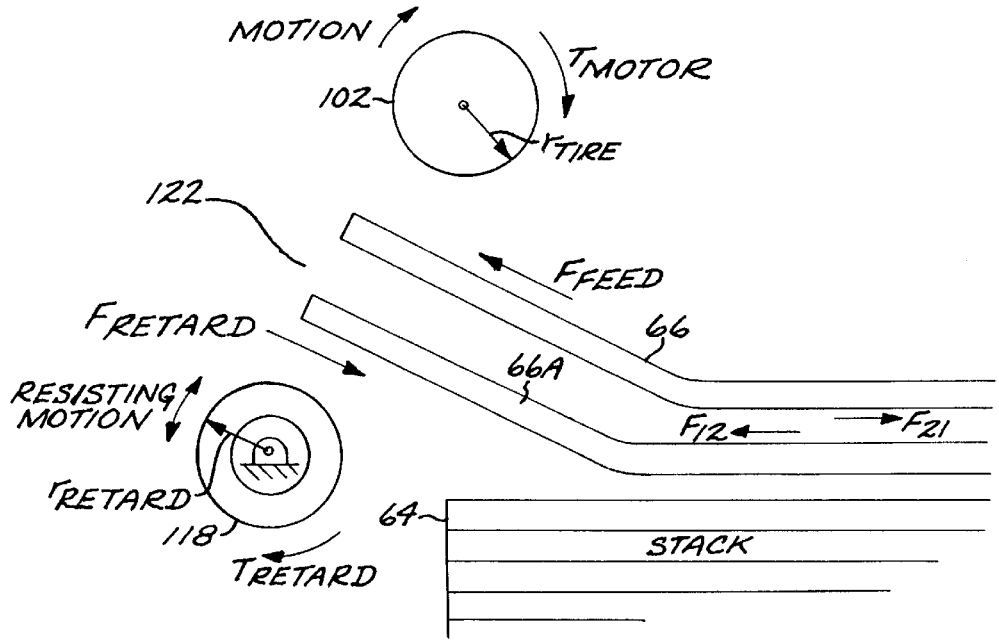

APPARATUS AND METHOD FOR PICKING AND FEEDING PRINT MEDIA SHEETS

TECHNICAL FIELD OF THE INVENTION

This invention relates to devices for picking sheets from a stack of sheet media, and more particularly to a sheet feeding apparatus for picking and separating the top sheet in a stack.

BACKGROUND OF THE INVENTION

Printers typically employ an input tray in which a stack of input print media such as sheets of paper or other print media are held. The printer has a sheet feeder which picks the top sheet of the stack and feeds the picked sheet along a paper path to a print area in which the printing operation takes place. In a known type of sheet feeder, during the pick operation, the stack is lifted up to a pick roller with a linearly stationary axis. The pick roller is then rotated to pick the top sheet from the stack and feed the picked sheet into the paper path. The consistency of the pick force with such an arrangement depends on the stack height as well as the amount of force delivered to lift the stack lip via a transmitted torque from a motor or spring. The torque margin and spring force inconsistencies provide challenges to overcome in order to achieve pick reliability. Moreover, this type of pick arrangement is limited to relatively short stacks of print media, since lifting higher media stacks, e.g. larger than 250 sheets, can be costly.

It would therefore be an advantage to provide a technique to pick sheets from a relatively large media stack, which provides a relatively constant pick force.

It would further be advantageous to provide a technique for picking the top sheet and also separating any multi-picked sheets.

SUMMARY OF THE INVENTION

A pick system is described for picking a top sheet of a medium from a media stack. The system includes a pick roller and a retard roller assembly arranged in cooperative relationship to form a nip between adjacent external surfaces of the pick roller and the retard roller. The pick roller is positioned adjacent a leading edge of the top sheet and in contact with a top surface of the top sheet. A pick roller drive apparatus is coupled to the pick roller for rotating the pick roller during a pick operation, the pick roller applying a force to the top sheet to drive the top sheet into the nip and into a media path. The retard roller includes a torque limiter apparatus for applying a retard force to the retard roller tending to resist the rotation of the retard roller as print media is driven into the nip during a pick operation. The retard force is less than a feed force applied to the top sheet by the pick roller as the top sheet is passed into the nip, the retard force being greater that a sheet-to-sheet frictional drag force between the top sheet and an adjacent sheet, thereby separating the adjacent sheet from the top sheet to prevent multiple sheet picks.

In accordance with an aspect of the invention, the pick system does not require a lifting structure to lift the stack during the pick operation. The pick force on the top sheet is relatively constant for various stack heights.

According to another aspect of the invention, a method is described for picking sheets from a stack of sheets, comprising the following steps:

positioning a pick roller and a retard roller assembly to form a nip between adjacent external surfaces of the pick roller and the retard roller, the pick roller being positioned adjacent a leading edge of the top sheet and in contact with a top surface of the top sheet;

rotating the pick roller during a pick operation to apply a force to the top sheet to drive the top sheet into the nip and into a media path; and applying a retard force to the retard roller tending to resist the rotation of the retard roller as print media is driven into the nip during a pick operation, the retard force less than a feed force applied to the top sheet by the pick roller as the top sheet is passed into the nip, the retard force being greater than a sheet-to-sheet frictional drag force between the top sheet and an adjacent sheet, thereby separating an adjacent sheet from the top sheet to prevent multiple sheet picks.

BRIEF DESCRIPTION OF THE DRAWING

These and other features and advantages of the present invention will become more apparent from the following detailed description of an exemplary embodiment thereof, as illustrated in the accompanying drawings, in which:

FIG. 5 illustrates in exploded side view the case of a single sheet pick or feed for the system of FIG. 1.

FIG. 6 illustrates in exploded side view the case of a multiple pick situation.

DETAILED DESCRIPTION OF THE PREFERRED EMBODIMENTS

Figure 1:
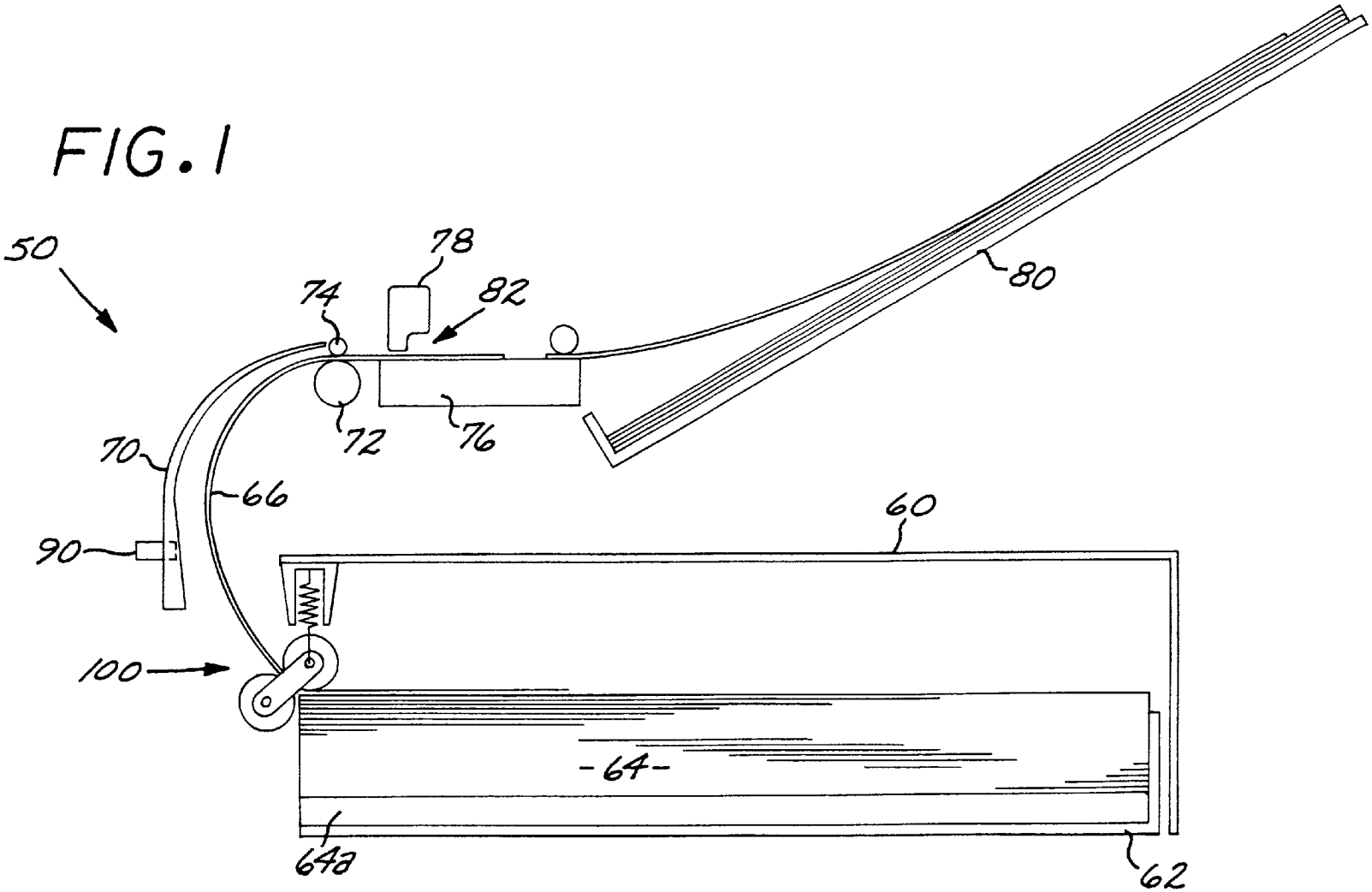
FIG. 1 is a simplified diagrammatic side view of a printer embodying a sheet pick system in accordance with an aspect of the present invention.

An inkjet printer 50 employing a sheet pick apparatus in accordance with the invention is illustrated in FIG. 1 in diagrammatic side view. The printer includes a media tray enclosure 60 housing an input media tray 62. The input media stack 64 is positioned on a raised platform 62A comprising the input media tray. In accordance with one aspect of the invention, it is anticipated that the stack 64 could contain a relatively large amount of sheets, say 500 sheets or more.

A sheet pick apparatus 100 in accordance with the invention picks the top sheet 66 from the stack, and drives the sheet along a paper path defined by a rear paper guide 70 and into the nip between a feed roller 72 and idler roller 74. The drive roller feeds the sheet onto a platen 76 where inkjet pens 78 eject ink droplets in a controlled fashion to form a desired image. The pens may be supported on a movable carriage for controlled motion along a swath axis transverse to the direction of paper advancement. As the sheet 66 is advanced through the print area 82, it is ejected onto a media output tray 80. A sensor 90 is tripped by the sheet 66 as it passes the sensor, providing an indication of the position of the leading edge of the sheet 66.

It will be appreciated that the invention is not limited to use with inkjet printers, but is useful with many types of office machines such as scanners, copiers, facsimile machines and other machines using a sheet advance mechanism, which picks a sheet from an input stack. Further, the invention is not limited to use with paper as the sheet media, but in general can be used for many different types of media, particularly print media such as card-stock, transparencies, photographic paper, fabric, mylar, metalized media, and the like; for convenience, the illustrated embodiment is described using paper as the print medium.

Figure 2:
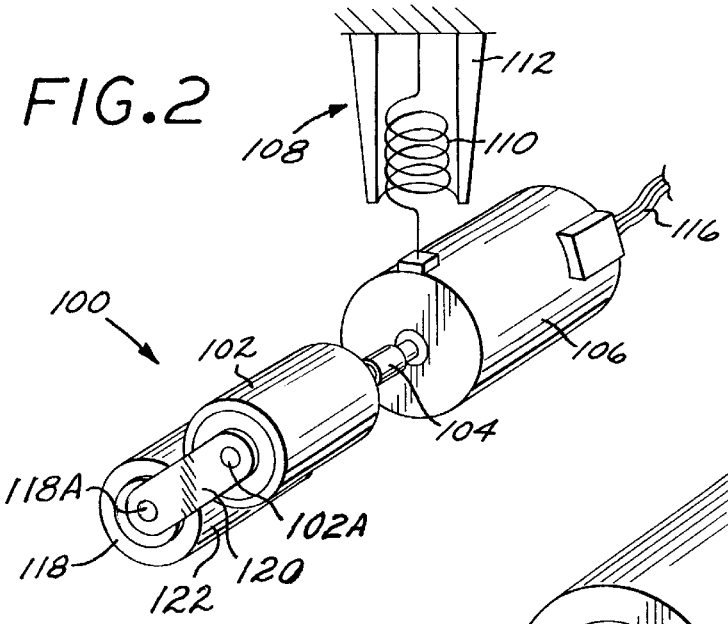
FIG. 2 is a simplified side isometric view of the sheet pick system.

FIG. 2 is a side isometric view of the sheet pick apparatus 100. A pick roller 102 is coupled through a coupler 104 to a drive motor 106, which provides rotational drive to the pick roller. The motor is suspended by a motor suspension 108, which is shown in this exemplary embodiment as a spring 110 guided by a guide structure 112, with the spring attached to an enclosure structure 114 situated above the media stack. A flexible wiring bundle 116 connects the motor to a motor driver/controller (not shown in FIG. 2).

The apparatus 100 further includes a retard roller structure 118 which is coupled to the pick roller 102 by a set of couplers 120 at each end of the rollers. The set of couplers hold the rollers 102, 118 in a parallel arrangement, creating a nip 122 between the two rollers. The couplers provide some small range of movement to allow the nip to open slightly, and can include a spring arrangement which biases the roller axles 102A, 118A toward each other, with axle 118A riding in a slot formed in the coupler structure 120.

In an exemplary embodiment, the retard roller and pick roller have a length on the order of 1½ inches to 2 inches, and outer diameters in the range of ¾ inch to 1¼ inches. The outer peripheral surfaces of each roller can be formed by an elastomeric tire, e.g. formed of rubber.

The motor suspension 108 provides an upwardly directed suspension force on the motor 106 which offsets somewhat the weight of the motor, yet permits the motor to move in a vertical direction with the pick roller 102. The pick roller 102 rides on the leading edge of the topmost sheet in the media stack 64. As sheets of print media are picked from the media stack 64, the height of the stack will decrease, and pick roller will move down. The motor moves vertically with the pick roller.

The platform 62A portion of the tray 62 provides sufficient height clearance of the bottom sheet of the stack 64 to permit the bottom sheet to be picked by the roller 102, without impeding the operation of the retard roller. Other arrangements could alternatively be made, e.g. by fashioning an opening in the tray to permit the pick assembly to drop through while retaining the ability to pick a sheet on the tray surface.

It will be appreciated that other types of structures can be employed to position the pick roller and retard roller in the appropriate position on the top sheet. For example, pivoted linkages, with belt or gear drive arrangements to drive the pick roller from a remote, fixed motor assembly, could alternatively be employed.

During a pick cycle, the pick roller 102, driven by the motor 106, rotates clockwise, picking the top sheet 66 of the media stack 64 and feeding it into the media path. The retard roller 118 separates any multi-picked sheets, rotating clockwise. Otherwise, if only a single sheet is picked, the retard roller 118 rotates counterclockwise with the pick roller. This action is achieved by a torque limiter 130, shown in further detail in FIG. 3, built into the retard roller structure 118.

Figure 3:
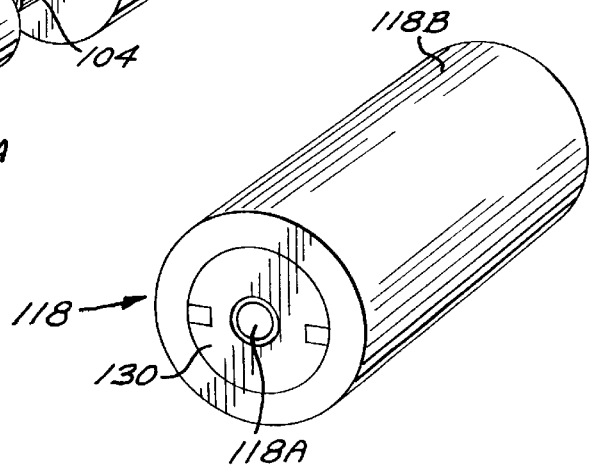
FIG. 3 is an isometric view illustrating the retard roller with its torque limiter.

FIG. 3 is an isometric view of the retard roller structure 118. The structure includes a shaft 118A, an outer tire 118B mounted on the outer periphery of the roller structure, and a bi-directional torque limiter 130 coupling the shaft and the outer tire structure. The tire structure 118B is a material such as rubber, foam or other elastomeric material with a high coefficient of friction and some compliance. Torque limiters suitable for the purpose are commercially available. One exemplary device is marketed by Kanematsu USA, Somerset N.J., as the Ogura OPL series of slip clutch/torque limiters, which employs a permanent magnet torque limiter. The permanent magnet torque limiting structure is bearing mounted on the axle shaft.

It is noted that rollers incorporating torque limiters have been used with a driven roller to create a nip located in the paper advance path for a laser printer. This structure was used in the Hewlett-Packard 5 Si laser printer, at a fixed location downstream of the D-roller pick mechanism with a corner separation system to separate multiple picks, to provide a secondary sheet separation mechanism. This combination of a driven roller with the roller including a torque limiter was used only for sheet separation, and not for picking sheets from an input stack.

Figure 4:
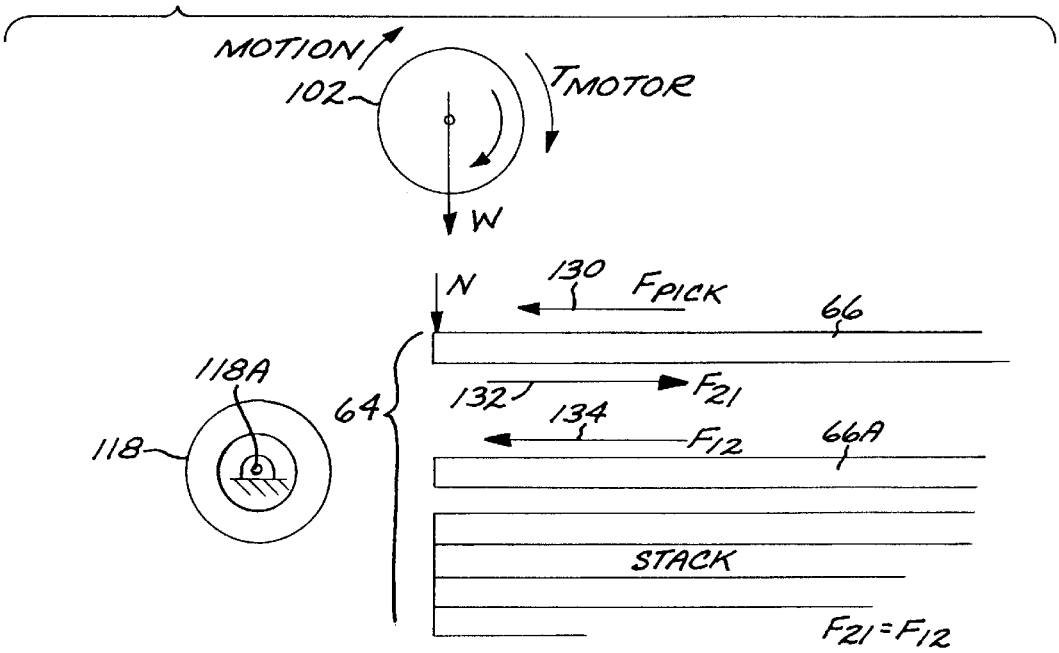
FIG. 4 shows in exploded side view the pick roller and the retard roller.

The operation of the pick apparatus 100 is illustrated in the diagrammatic illustrations of FIGS. 4–6. FIG. 4 shows in exploded side view the pick roller 102 and the retard roller 118. The stack 64 of print media is also shown in partially exploded form, with the top sheet 64 and the sheet 64A next in order on the stack. With the pick roller resting on the top sheet as illustrated in FIG. 1, a force N generally equal to the weight of the pick roller, the motor (less the upward force exerted by the suspension 108) and the retard roller will be exerted perpendicular to the surface of the top sheet. When the motor 106 is actuated, a torque $T_{motor}$ is applied to the pick roller. As the pick roller rotates, a pick force $F_{pick}$ indicated by arrow 130 is exerted on the top sheet 66 as a result of the friction between the roller and the top sheet. $F_{pick}$ is equal to the force N times the friction coefficient of the material forming the outer surface of the roller or tire, $\mu_{tire}$. This pick force tends to move the top sheet in the desired direction, but a force $F_{21}$ indicated by arrow 132 opposes the pick force $F_{pick}$. The opposing force is due to the friction $\mu$ between the sheets 64 and 64A; $F_{21}=N\mu$. The top sheet will be picked when $F_{pick}>F_{21}$. In this case, the force $F_{21}$ is opposed by equal force $F_{12}$ indicated by arrow 134 tending to pull the second sheet 66A with the picked sheet 66.

FIG. 5 illustrates the case of a single sheet pick or feed, which is the desired result. Here, a media feed force $F_{feed}$ is being exerted on the top sheet 66 by the pick roller 102. $F_{feed}$ is on the order of the ratio of the motor torque and the radius $R_{tire}$ of the pick roller tire, $F_{motor}/R_{tire}$. The top sheet 66 is being fed through the nip between the pick roller 102 and the retard roller 118. The retard roller has a radius $R_{retard}$. A force $F_{feed}$ is exerted on the retard roller surface by the picked sheet 66. The retard roller 118 includes a torque limiter, which exerts a magnetically induced torque $F_{retard}$ tending to oppose the feed force $F_{feed}$. $F_{retard}$ is selected to be less than the feed force $F_{feed}$, and so the retard roller rotates counterclockwise as the sheet is driven through the nip by the torque exerted by the pick roller.

Now consider the multiple pick case, where more than one sheet is pulled from the stack during the pick process and fed into the nip 122. This is illustrated in FIG. 6. Friction between the top sheet 66 and the second sheet 66A may drag the second sheet with the top sheet into the nip 122 between the pick roller 102 and the retard roller structure 118. If this occurs, the second sheet will be peeled off by the force $F_{retard}$ exerted on the second sheet by the retard roller. This is because $F_{retard}$ is selected to be greater than $F_{12}$, the force resulting from frictional engagement between the top sheet and the second sheet. As a result, the second sheet 66A moves back to the stack, under force of gravity or through some backlash in the torque limiter structure, and feed of the single sheet occurs as shown in FIG. 5.

The magnitude of the feed force $F_{feed}$ is dependent on the motor torque, the pick roller tire size and material and the motor speed. In an exemplary embodiment, $F_{feed}$ is in the range of 800 grams to 1100 grams. The magnitude of the pick force $F_{pick}$ is dependent on such factors as the pick roller tire material and size, the media type and wear. In the exemplary embodiment, $F_{pick}$ is on the order of 300 grams to 500 grams. The magnitude of the retard force $F_{retard}$ is dependent on the retard roller size and the parameters of the torque limiter, in this exemplary embodiment the magnet size. In this embodiment, $F_{retard}$ is on the order of 30 grams to 60 grams.

Figure 7:
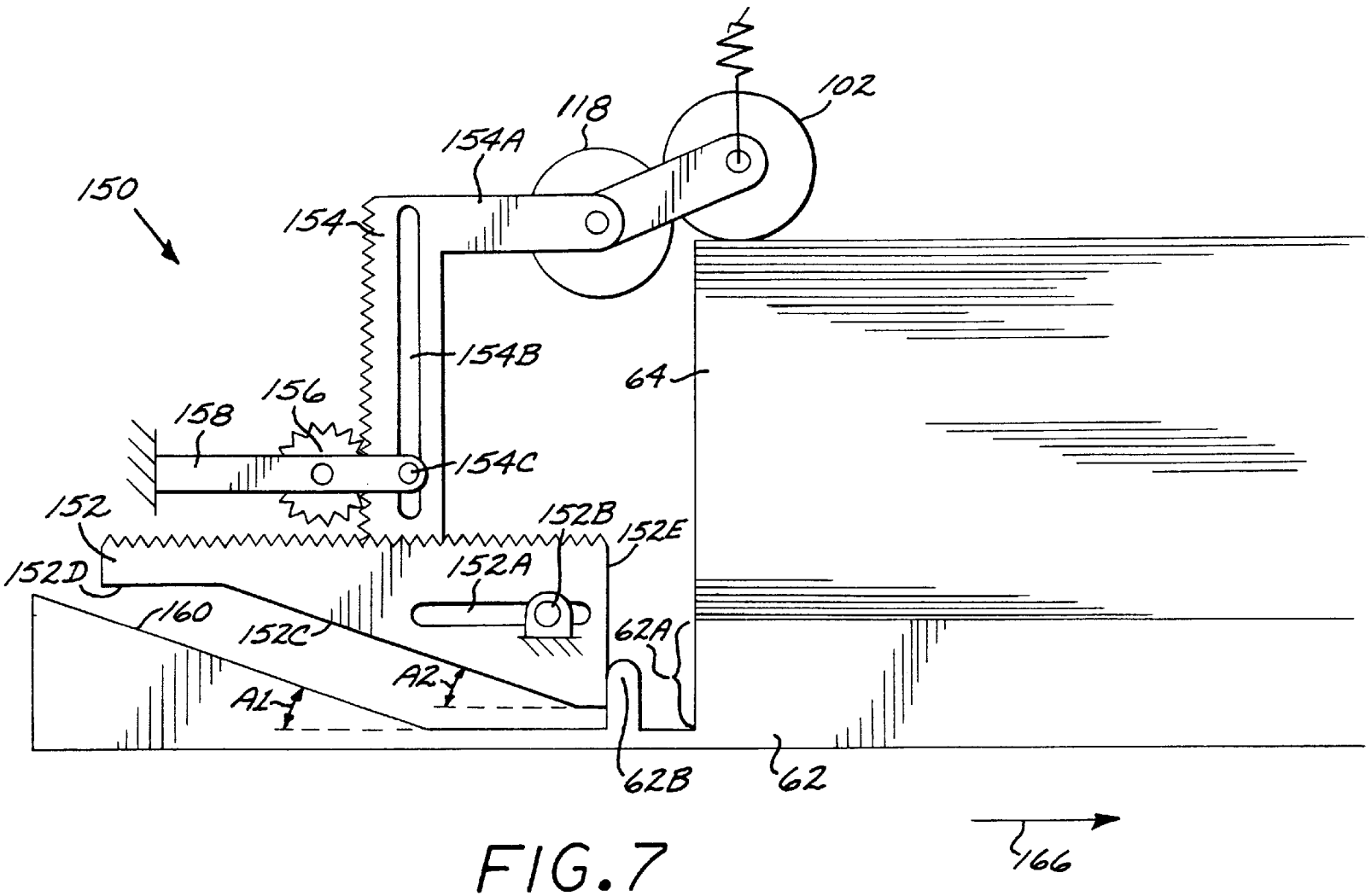
FIG. 7 is a diagrammatic side view illustrating the media tray with an apparatus for lifting the pick assembly when the input tray is pulled out.

A device employing the sheet pick apparatus 100 to pick sheets from a removable input tray may include a mechanism to lift the apparatus 100 during tray removal, e.g. to replenish the media stack. This would facilitate the proper positioning of the pick roller on a fresh stack in the position shown in FIG. 1. An exemplary mechanism 150 for positioning the apparatus 100 is illustrated in FIG. 7. This mechanism is a double rack and pinion assembly, comprising a first, horizontal, rack 152, a second, vertical, rack 154, a pinion gear 156 mounted for rotation at the end of a fixed support bracket 158, and a cam surface 160 protruding from the tray 62 at an angle A1. The bracket 158 holds the pinion gear 156 at an elevation relative to the rack 152 such that the gear 156 does not engage rack 152 when the tray is in the fully inserted position for pick operation. The rack 152 includes a slot 152A which receives therethrough a pin 152C whose position is fixed. Thus, movement of the rack 152 is constrained by the pin 152C and the slot 152A. The rack 152 has a ramp undersurface 152C defining an angle A2 with respect to the tray surface when the rack 152 is at the horizontal, with angle A2 equalling angle A1, and a surface 152D which is parallel to the tray surface when the rack 152 is at the horizontal. The vertical rack 154 includes an angle bracket portion 154A which holds both ends of the retard roller axle 118A. A slot 154B is formed in the rack to receive pin 154C mounted at the end of the fixed bracket 158, thereby constraining movement of the rack 154.

Pulling the tray 62 out in the direction of arrow 166 causes surface 160 to contact the surface 152D and eventually surface 152C of the rack 152, lifting the rack 152 up into engagement with the pinion gear 156. The rack 152 is also canted slightly in a clockwise direction, by the contact of the surfaces 160 and 152D. As the tray is drawn out in the direction of arrow 166, the rack 152 drives the pinion gear counterclockwise. Because the pinion gear is also in engagement with the second rack 154, the rotation of the pinion gear will lift the second rack 154, carrying the retard roller 118 and the apparatus 100 upwardly. Continued movement of the tray in the direction of arrow 166 brings the end of the slot 152A against the pin 152B, stopping further sliding movement of the tray in the direction of arrow 166. A fresh stack of print media can be placed on the tray platform surface with the tray in this access position, and then the tray is pushed back in the direction opposite to arrow 166. This ultimately brings the tray lug 62B against the end surface 152E of rack 152, pushing the rack back to the location at which the pin 152B stops against the other slot end of slot 152A, stopping further movement of the tray. At this point, the surface 160 is not in contact with the surface 152D of the rack, and so the rack 152 is not in engagement with the pinion gear 156. The rack 154 is free to drop, with the pick roller and retard roller assembly, until the pick roller is in the pick position on the top sheet of the stack 62 adjacent its leading edge.

Other apparatus for lifting the pick assembly when refilling the media stack could alternatively be employed. For example, the pick roller assembly could be lifted by a motorized elevator system.

Figure 8:
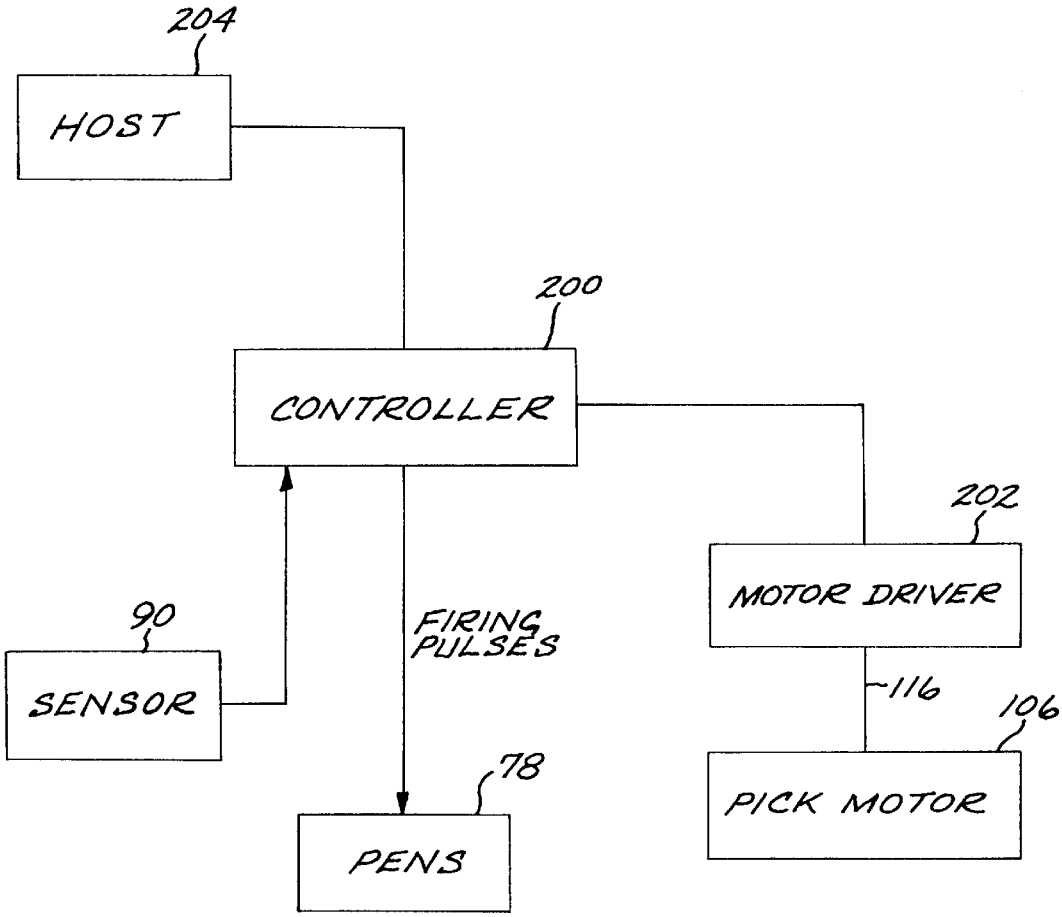
FIG. 8 is a simplified control block diagram of the printer device of FIG. 1.

FIG. 8 is a simplified schematic block diagram, illustrating the control elements for the pick system as incorporated in the inkjet printer 50 of FIG. 1. A printer controller 200 is responsive to commands provided by a host 204 such as a personal computer, or from a key panel (not shown), in a conventional manner, to initiate a pick sequence. The controller issues motor drive commands to the motor driver 202, which sends the motor drive signals to the pick motor 106 via the wiring 116. After a sheet is picked and passed into the media path, the sensor 90 will be tripped by the leading edge of the picked sheet, indicating a successful pick. The controller will then control additional sheet drive elements (not shown) such as those driving roller 70, to properly advance the sheet to the print zone 82. The controller 200 provides firing pulses to the printheads of the pens 78 in a controlled manner, according to the commands received from the host 204, and thereafter causes the sheet to be advanced to the output tray 80. The pick process is then repeated as needed to complete a print job. Failure of the sensor 90 to be tripped as expected can indicate that the input tray is empty, and the printer needs operator service.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A machine including capability of feeding media, comprising:

an input stack of sheets of media;

a media path along which sheets of said media are passed from the input stack;

a pick system for picking a top sheet from the input stack, comprising:

a pick roller and a retard roller assembly arranged in cooperative relationship to form a nip between adjacent external surfaces of the pick roller and the retard roller, the pick roller being positioned adjacent a leading edge of the top sheet and in contact with a top surface of the top sheet;

a pick roller drive apparatus coupled to the pick roller for rotating the pick roller during a pick operation, the pick roller applying a force to the top sheet to drive the top sheet into the nip and into a media path;

the retard roller including a torque limiter apparatus for applying a retard force to the retard roller tending to resist the rotation of the retard roller as print media is driven into the nip during a pick operation, the retard force less than a feed force applied to the top sheet by the pick roller as the top sheet is passed into the nip, the retard force being greater that a sheet-to-sheet frictional drag force between the top sheet and an adjacent sheet; and a suspension apparatus coupled to the pick roller and retard roller assembly for permitting the assembly to move through a range of movement as the height of the media stack changes due to repeated pick operations, such that the pick roller is in contact with the top sheet for media stacks of varying heights.

2. The machine of claim 1 further including an image recording apparatus at an image recording area along the media path.

3. The machine of claim 1 wherein the image recording apparatus includes an inkjet printhead.

4. A method for picking sheets from a stack of sheets, comprising the following steps:

positioning a pick roller and a retard roller assembly to form a nip between adjacent external surfaces of the pick roller and the retard roller, the pick roller being positioned adjacent a leading edge of a top sheet of the stack of sheets and in contact with a top surface of the top sheet;

rotating the pick roller during a pick operation to apply a force to the top sheet to drive the top sheet into the nip and into a media path;

applying a retard force to the retard roller tending to resist the rotation of the retard roller as print media is driven into the nip during a pick operation, the retard force less than a feed force applied to the top sheet by the pick roller as the top sheet is passed into the nip, the retard force being greater than a sheet-to-sheet frictional drag force between the top sheet and an adjacent sheet, thereby separating an adjacent sheet from the top sheet to prevent multiple sheet picks; and as the stack is depleted, allowing the pick roller and retard roller assembly to move through a range of movement while still maintaining contact with the media stack top sheet to maintain a relatively constant pick force for the successive sheets in the stack.

5. A pick system for picking a top sheet of a medium from a media stack, comprising:

a pick roller and a retard roller assembly arranged in cooperative relationship to form a nip between adjacent external surfaces of the pick roller and the retard roller, the pick roller being positioned adjacent a leading edge of the top sheet in the media stack and in contact with a top surface of the top sheet;

a pick roller drive apparatus coupled to the pick roller for rotating the pick roller during a pick operation, the pick roller applying a force to the top sheet to drive the top sheet into the nip and into a media path;

the retard roller including a torque limiter apparatus for applying a retard force to the retard roller tending to resist the rotation of the retard roller as print media is driven into the nip during a pick operation, the retard force less than a feed force applied to the top sheet by the pick roller as the top sheet is passed into the nip, the retard force being greater than a sheet-to-sheet frictional drag force between the top sheet and an adjacent sheet, thereby separating the adjacent sheet from the top sheet to prevent multiple sheet picks; and a suspension apparatus coupled to the pick roller and retard roller assembly for permitting the assembly to move through a range of movement as the height of the media stack changes due to repeated pick operations, such that the pick roller is in contact with the top sheet for media stacks of varying heights.

6. The system of claim 5 further characterized in that the system is free of apparatus for lifting the media stack during a pick operation.

7. The system of claim 5 wherein the torque limiter apparatus employs a permanent magnet torque limiter.

8. The system of claim 5 wherein the system is free of an active drive system for directly driving the retard roller.

9. A pick system for picking a top sheet of a medium from a media stack, comprising:

a pick roller and a retard roller assembly arranged in cooperative relationship to form a nip between adjacent external surfaces of the pick roller and the retard roller, the pick roller being positioned adjacent a leading edge of the top sheet in the media stack and in contact with a top surface of the top sheet;

a pick roller drive apparatus coupled to the pick roller for rotating the pick roller during a pick operation, the pick roller applying a force to the top sheet to drive the top sheet into the nip and into a media path, the drive apparatus including a drive motor, a coupling for coupling the drive motor to the pick roller, and a suspension system coupled to the motor permitting the motor to move with the assembly through a range of movement as the media stack is depleted;

the retard roller including a torque limiter apparatus for applying a retard force to the retard roller tending to resist the rotation of the retard roller as print media is driven into the nip during a pick operation, the retard force less than a feed force applied to the top sheet by the pick roller as the top sheet is passed into the nip, the retard force being greater than a sheet-to-sheet frictional drag force between the top sheet and an adjacent sheet, thereby separating the adjacent sheet from the top sheet to prevent multiple sheet picks.

10. The system of claim 9 wherein the media stack is held in a tray in a stationary position during pick operations.

11. The system of claim 9 wherein the suspension system includes a biasing apparatus for taking up a portion of the weight of the motor.

12. A printer device, comprising:

an input stack of sheets of print media;

a printing apparatus disposed at a print zone;

a media path through which sheets of said print media are passed between the input stack and the print zone for printing operations by the printing apparatus;

a pick system for picking a top sheet from the input stack, comprising:

a pick roller and a retard roller assembly arranged in cooperative relationship to form a nip between adjacent external surfaces of the pick roller and the retard roller, the pick roller being positioned adjacent a leading edge of the top sheet and in contact with a top surface of the top sheet;

a pick roller drive apparatus coupled to the pick roller for rotating the pick roller during a pick operation, the pick roller applying a force to the top sheet to drive the top sheet into the nip and into a media path;

the retard roller including a torque limiter apparatus for applying a retard force to the retard roller tending to resist the rotation of the retard roller as print media is driven into the nip during a pick operation, the retard force less than a feed force applied to the top sheet by the pick roller as the top sheet is passed into the nip, the retard force being greater that a sheet-to-sheet frictional drag force between the top sheet and an adjacent sheet; and a suspension apparatus coupled to the pick roller and retard roller assembly for permitting the assembly to move through a range of movement as the height of the media stack changes due to repeated pick operations, such that the pick roller is in contact with the top sheet for media stacks of varying heights.

13. The printer of claim 12 wherein the printing apparatus includes an inkjet pen.

14. The printer of claim 12 wherein the media stack is held in a tray in a stationary position during pick operations.

15. A printer device, comprising:

an input stack of sheets of print media;

a printing apparatus disposed at a print zone;

a media path through which sheets of said print media are passed between the input stack and the print zone for printing operations by the printing apparatus;

a pick system for picking a top sheet from the input stack, comprising:

a pick roller and a retard roller assembly arranged in cooperative relationship to form a nip between adjacent external surfaces of the pick roller and the retard roller, the pick roller being positioned adjacent a leading edge of the top sheet and in contact with a top surface of the top sheet;

a pick roller drive apparatus coupled to the pick roller for rotating the pick roller during a pick operation, the pick roller applying a force to the top sheet to drive the top sheet into the nip and into a media path;

the retard roller including a torque limiter apparatus for applying a retard force to the retard roller tending to resist the rotation of the retard roller as print media is driven into the nip during a pick operation, the retard force less than a feed force applied to the top sheet by the pick roller as the top sheet is passed into the nip, the retard force being greater that a sheet-to-sheet frictional drag force between the top sheet and an adjacent sheet; and a drive motor, a coupling for coupling the drive motor to the pick roller, and a suspension system coupled to the motor permitting the motor to move with said assembly through a range of movement as the media stack is depleted.

16. The printer of claim 15 wherein the suspension system includes a biasing apparatus for taking up a portion of the weight of the motor.

17. The printer of claim 13 wherein the input stack is held in a tray, the tray movable to allow replenishment of the media stack, and further comprising apparatus for moving the pick roller and retard roller assembly to a refill position when the tray is moved to refill the stack.

18. The printer of claim 17 wherein the apparatus for moving the pick roller and retard roller assembly is actuated by movement of the tray from an operational position to a refill position.

* * * * *